United States Patent [19]

Sasse

[11] 4,413,825

[45] Nov. 8, 1983

[54] GOLF CLUB

[76] Inventor: Howard A. Sasse, 27 Clyde Ave., Buffalo, N.Y. 14215

[21] Appl. No.: 936,217

[22] Filed: Aug. 24, 1978

Related U.S. Application Data

[63] Continuation-in-part of Ser. No. 781,502, Mar. 25, 1977, abandoned.

[51] Int. Cl.[3] ..... A63B 53/04

[52] U.S. Cl. ..... 273/175

[58] Field of Search ..... 273/77 R, 80 C, 167 A, 273/167 F, 167 G, 167 J, 169, 171, 173, 174, 175, 168, 167 D

[56] References Cited

U.S. PATENT DOCUMENTS

| | | | |
|---|---|---|---|
| D. 136,005 | 7/1943 | Armstrong | 273/167 D |
| 1,337,958 | 4/1920 | Reach | 273/175 |
| 1,524,731 | 2/1925 | Davis | 273/175 |
| 1,526,951 | 2/1925 | Beaumont | 273/169 X |
| 2,395,837 | 3/1946 | Baymiller et al. | 273/175 |
| 3,368,812 | 2/1968 | Baldwin | 273/173 X |
| 3,390,881 | 7/1968 | Senne | 273/173 |
| 4,065,133 | 12/1977 | Gordos | 273/167 A X |

FOREIGN PATENT DOCUMENTS

| | | | |
|---|---|---|---|
| 22113 | of 1909 | United Kingdom | 273/167 A |
| 1432688 | 4/1976 | United Kingdom | 273/168 |

*Primary Examiner*—George J. Marlo
*Attorney, Agent, or Firm*—Donald C. Studley

[57] ABSTRACT

The present invention relates to an improved wood-type golf club. More particularly, it relates to a golf club which is designed to give the golfer maximum margin of error in making contact with the club head and the ball to obtain a straight trajectory on the ball. The shaft and the club head are so aligned that if the center line of the shaft is extended it will intercept a plane positioned perpendicular to the base of the club head and pass through the center of gravity of the club head. The striking face of the club head has a number of horizontal corrugations, ranging from 1/64 to $\frac{1}{8}$ inch in depth, which act as knuckle to strike the ball. The striking face of the club tapers inward from the bottom to top at an angle between about 10° to 15°. The area of the face nearest the toe of the club head is tapered inward toward the rear of the club head to compensate for side spin that would otherwise be imparted to a ball hit in the toe area. The club head is equipped with corrugations or runners 1/64 to $\frac{1}{8}$ inch in depth on the base thereof to aid in keeping the club straight if the bottom of the club comes in contact with the ground prior to hitting the ball.

2 Claims, 2 Drawing Figures

GOLF CLUB

This application is a continuation-in-part of U.S. Ser. No. 781,502 filed Mar. 25, 1977 now abandoned.

BACKGROUND OF THE INVENTION

It is estimated that, in the United States alone, more than 200,000,000 rounds of golf are played each year. Assuming that each round takes between 3½ and 4 hours, 700,000,000 to 800,000,000 person-hours are expended on the golf course in a single year. The present invention seeks to either lessen the number of person-hours, or to make such hours more enjoyable for the golfer.

Very basically, golf is a game of impact between the head of the golf club and a golf ball. No matter the course, the equipment, the grip, physique or stature of the golfer, his stance or timing, the proper contact between the club head and the golf ball is primary to a successful golf game.

During a downswing, a good golfer can generate up to four horsepower. During a full drive, the face of the driver is in contact with the golf ball for about ½ millisecond. From the amount of impact until the ball springs free of the driver, the ball and club travel together about three-fourths of an inch. The force applied to the ball by the club head during impact on a full drive rises to a peak of about 2,000 pounds. The average force applied during the ½ millisecond contact, that is, during contact of the club head and the ball until departure of the ball is about 1,400 pounds.

The time used by the club head of a driver going from rest (at the top of the backswing) to the bottom of the downswing, travelling at a speed of about 100 miles per hour, is about one-fifth second. On impact with a seven ounce driver head, the ball proceeds at about 135 miles per hour.

With these factors in mind, the present club is designed to give the golfer maximum effectiveness in controlling the aim and flight of the ball, while at the same time allowing a wide margin for error in the area of contact between the club head and the ball.

GENERAL DESCRIPTION OF THE INVENTION

The present golf club has several attributes which combine to produce rather wonderous results for the golfer. These attributes are separately described as follows.

The present golf club consists of a shaft and a club head. The club head is attached to the shaft and aligned therewith so that if the center line of the shaft is extended it will intercept, within the club head, a vertical plane which is perpendicular to the base of the club head and also passes through the center of gravity of the club head. The center of gravity is defined as a point at equal weight distances from the edges of the club head. The position of the vertical plane which passes through the center of gravity may be determined by balancing the club head at a point between the heel and toe on a knife edge.

Because of the unbalanced club head on most golf clubs in use today, the golfer has to hold rather tightly to the club handle to overcome the torque or twist of the shaft during a swing. The tight grip required tenses muscles and makes a loose, free swing almost impossible. The present club, being balanced, alliviates the torque during the swing and allows the golfer to concentrate on the smoothness of his swing and, most important, ball contact, rather than struggling to hold the striking face of the club on a straight line.

When the club head meets the ball, a twist or torque is introduced to the club shaft. The twist or torque on the shaft is increased when the ball is struck at a point not on the center portion of the striking face. The present alignment of the club shaft and club head minimizes the torque induced on the club shaft when the ball is hit at a point other than the center of the striking face and thereby minimizes the tendency of the ball to hook (turn right) or slice (turn left).

The striking face of the present head has a plurality of parallel corrugations or continuous elongated protuberances thereon extending from the toe to the heel of the club head. The corrugations are positioned horizontal to the club head. Generally from about three to about six corrugations are useful and particularly useful are from four to five. Preferably one of the corrugations is positioned adjacent to the base of the club head and extends outward slightly more than the other corrugations. The corrugations generally range from about 1/64 inch to about 1/16 inch in height as measured from the club face.

The base portion of the club head is equipped with a plurality of parallel corrugations, or runners, positioned in a plane perpendicular to the corrugations on the striking face and parallel to the direction that the club head would travel to strike a ball.

The function of the corrugations on the striking face is to give a knuckle-like striking surface for ball contact and the runners on the base portion of the club head provide an aid to the golfer to keep the club head straight during ball contact.

DETAILED DESCRIPTION OF THE INVENTION

The present invention may be described in greater detail and illustrated by reference to the attached drawings which are presented as illustrative and are not to be construed as limiting the invention to the specific embodiments described.

Figure 1:
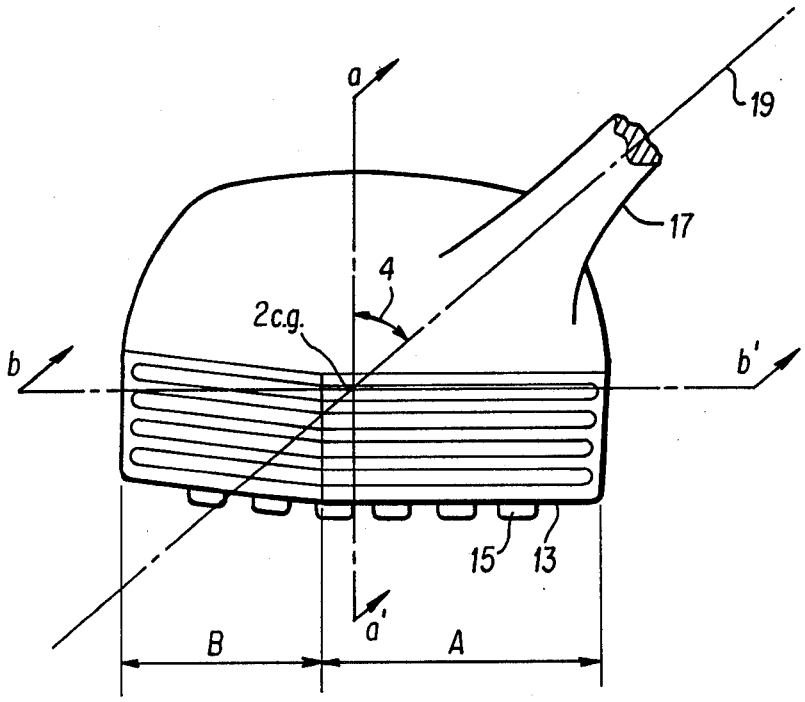
FIG. 1 is a frontal view of a wood-type golf club showing the striking face and runners and indicating the planes which may be utilized to position the club shaft and head in accord with the present invention.

Looking now at FIG. 1, club head 11 has a base portion 13. Base portion 13 has a plurality of corrugations, or runners, 15 thereon extending from the front to the back of the club head. Club head 11 has a plane a—a′ passing therethrough. Plane a—a′ is positioned perpendicular to base portion 13 and passes through the center 2 of gravity of club head 11. FIG. 1 also shows a second plane b—b′ passing through club head 11. Plane b—b′ may be used to align the club head and shaft in a more preferred alignment. Plane b—b′ is positioned perpendicular to plane a—a′ and as with plane a—a′ passes through the center of gravity of club head 11. Shaft 17, partially shown, is attached to club head 11 in such a manner that center line 19 of shaft 17 intercepts plane a—a′ within the confines of club head 11. Preferably the angle of intercept 4 is between about 30° and about 60°, and more preferably between about 50° and about 55°. Excellent results are obtained when the angle is about 53°. Preferably center line 19 is contiguous to a line formed by the intersection of planes a—a' and b—b' and, in a most preferred embodiment, center line 19 is contiguous to the center of gravity of the club head.

Runners 15 are positioned on base portion 13 of club head 11 to aid in maintaining the club head on a straight line during ball contact. The runners are expecially useful to stabilize the direction of the club head if the club comes in contact with the ground prior to hitting the ball. The mumber of runners is generally not critical. Usually from about two to about fifteen runners are used, however, from about five to about eight are usually sufficient to provide both a physical and a psychological aid for the golfer in maintaining a straight swing. Runners 15 usually are uniform in height and generally vary from about 1/64 inch to about 1/16 inch as measured from base portion 13. A height of about 1/32 inch has been found to be practical and useful. The runners generally vary from about ⅛ inch to about 1/64 inch in width. A width of about 1/16 inch is particularly adapted to use. The spacing between the runners is not critical and generally spacings of between about 1/16 inch and about ½ inch are used and found to be adequate.

The toe portion, the portion furtherest from the shaft, of the striking face is tapered inward toward back portion of club head 11. At least about 20%, and preferably about 40%, to about 50% of the striking face is so inwardly tapered. The angle of the taper, measured from the untapered portion of the striking face at the heel of the club head, generally ranges between about 6° and about 12°. An angle of about 8° has been found particularly adapted to use.

The tapered portion and the untapered portion of the striking face may be considered as dividing the striking face into two general striking area, A and B. If the ball is struck in the area A nearest the center of the striking surface, which is the most ideal contact portion, maximum distance and little or no side spin will be imparted to the ball. If the ball is struck in the area of A nearer the heel of the club head, the flight of the ball will be slightly to the left (hook), but because of the alignment of the shaft and club head, no side spin will be imparted to the ball. If the ball is struck in the area of B slightly less distance will be obtained than if the ball were hit in area A. However, the ball will fly straight because the angle of the face, which normally would apply side spin making the ball fly to the left, is counteracted by the main force at the point of impact which is centralized in the club head, but is off-center to the ball.

Figure 2:
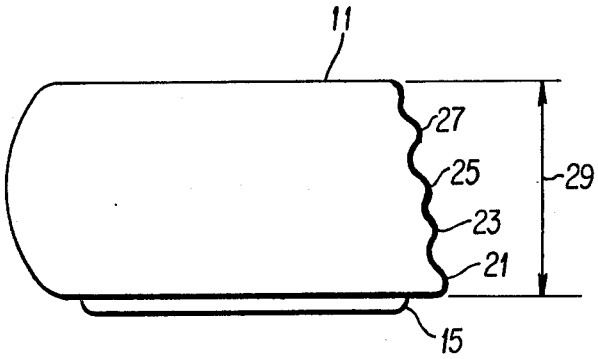
FIG. 2 is a side view of a club of the present invention showing the arrangement of the corrugations or protrusions in the striking face.

FIG. 2 is a side view of the club of FIG. 1 showing corrugations 21, 23, 25 and 27 positioned on striking face 29. In a preferred embodiment one of the corrugations, 21 is positioned at the base of club head 11 and protrudes outwardly slightly further than the other corrugations. The extended corrugation at the bottom of the striking face acts as a scoop when the ball is hit. Striking face 29 of the club head is preferably tapered from the top to the bottom of the face at an angle of between about 10° and 15° and most preferred is an angle of between about 12° and about 13°.

In use corrugation 21 acts as a scoop allowing the golfer to get under the ball with the lower and leading portion of the club head thereby giving the ball loft. Corrugations 23, 25 and 27 acts as knuckles. When a ball is hit these corrugations penetrate the ball providing maximum compression of the ball at the point of contact and thereby projecting the ball a maximum distance.

Corrugations 23, 25 and 27 protrude from the striking face from about 1/64 inch to about ⅛ inch and preferably about 1/32 inch. Although the leading edges of the corrugations may be square, best results are obtained when the edges are rounded or slightly rounded. The corrugations usually range in width from about 1/16 inch to about ¼ inch in width and within that range widths of between about ⅛ inch and about 3/16 inch are aptly suited to use. The spacing between corrugations depends upon the number of corrugations utilized in the striking face. Spacings of between about 1/16 inch and ¼ inch have been found particularly useful to give the desired surface for contact with a golf ball. When striking face 29 is slightly rounded or bulged, corrugations 23, 25 and 27 act to apply a more concentrated penetration of the ball, preferably at a point above the center of the ball. This action tends to apply an overspin to the ball and results in greater distance in the air and longer roll after the ball hits the ground.

The material of the club head and shaft are not critical to the present invention, and those materials generally used to fabricate golf equipment may be readily adapted to use with the present club, namely wood, plastic or metal for the club head, and wood, metal, plastic, graphite or fiberglass for the shaft.

The invention described in the preceding specification includes in scope such modifications and/or equivalents as would be obvious substitutes to a person of skill in the art.

What is claimed is:

1. A wood-type golf club comprising a club head and a club shaft, said club head and shaft joined so that the center line of the shaft, when extended, intercepts a vertical plane within the confines of the club head which is perpendicular to the base of the club head and passes through the center of gravity of said club head, said club head having a striking face and a base portion, said striking face having a plurality of parallel corrugations thereon, ranging from 1/64 to ⅛ inch in depth, said corrugations positioned parallel to said base, one of said corrugations positioned at the bottom of the striking face, said striking face tapering outward from the top to the bottom of the face at an angle of from about 10° to about 15°, said club having a toe and heel portion, 25 to 50 percent of the surface of said striking face positioned nearest the toe portion tapered inward toward the back of the club head, at an angle between about 6° and about 12° to form two separate, substantially planar ball-striking surfaces on said striking face, the base portion of said club head consisting of a plurality of parallel runners thereon, said runners positioned parallel to the direction that the club would travel to strike a ball.

2. The golf club of claim 1 wherein the said runners extend from about 1/64 to about 1/16 inch from said base portion.

* * * * *